US008016700B2

(12) United States Patent
McTavish et al.

(10) Patent No.: US 8,016,700 B2
(45) Date of Patent: Sep. 13, 2011

(54) TENNIS BACKBOARD

(76) Inventors: Hugh McTavish, Birchwood, MN (US); Johannes N. Gaston, Minnetonka, MN (US); Douglas J. VanOrnum, Minnetonka, MN (US); Brian D. Gale, Blaine, MN (US); Steven A. Beaudry, Minneapolis, MN (US)

( * ) Notice: Subject to any disclaimer, the term of this patent is extended or adjusted under 35 U.S.C. 154(b) by 422 days.

(21) Appl. No.: 12/009,642

(22) Filed: Jan. 19, 2008

(65) Prior Publication Data

US 2008/0227571 A1 Sep. 18, 2008

Related U.S. Application Data

(63) Continuation-in-part of application No. 11/445,852, filed on Jun. 3, 2006, now Pat. No. 7,677,993.

(60) Provisional application No. 60/688,582, filed on Jun. 8, 2005.

(51) Int. Cl.
*A63B 69/38* (2006.01)

(52) U.S. Cl. ..... 473/459; 473/434; 473/435

(58) Field of Classification Search ..... 473/459, 473/435, 434

See application file for complete search history.

(56) References Cited

U.S. PATENT DOCUMENTS

| | | | | |
|---|---|---|---|---|
| 4,093,218 | A | 6/1978 | Burchers | |
| D265,413 | S | 7/1982 | Millikan | |
| 4,373,720 | A * | 2/1983 | Lombardi et al. | 473/434 |
| 4,421,318 | A * | 12/1983 | Sverdlik et al. | 473/476 |
| 4,491,321 | A * | 1/1985 | Veenema | 472/92 |
| 4,588,190 | A * | 5/1986 | Stewart et al. | 473/435 |
| 4,693,472 | A * | 9/1987 | Newman et al. | 473/435 |
| 5,833,234 | A * | 11/1998 | Vavala et al. | 473/434 |
| 5,857,679 | A * | 1/1999 | Ringe et al. | 473/435 |
| 7,677,993 | B2 * | 3/2010 | McTavish | 473/434 |
| 2003/0236139 | A1 * | 12/2003 | Jensen et al. | 473/434 |
| 2005/0049088 | A1 * | 3/2005 | Chang et al. | 473/434 |

* cited by examiner

*Primary Examiner* — Raleigh W. Chiu
(74) *Attorney, Agent, or Firm* — Hugh McTavish

(57) ABSTRACT

The invention provides a new tennis backboard design. The backboard includes a firm backing layer underlying a soft deadening layer. The rebound of a tennis ball from the backboard is reduced as compared to rebound from a rigid hard-surface backboard. This allows a player to stand fairly close to the backboard, which reduces misses. The player can stand fairly close and hit balls hard against the backboard. Because the rebound is reduced, the ball simply bounces back softly and easily to the player, allowing the player to hit hard again from a fairly short distance. Thus, long rallies without missing are easily achieved. Since the bounce is reduced, the player can stand closer to the backboard, and therefore the backboard can be smaller than conventional backboards without the player missing the backboard. This allows the backboard to be light, portable, and easily stored. Because of the addition of a soft deadening layer, the firm backing layer of the backboard can also be thin and made of lighter and weaker material than a conventional backboard, reducing the weight of the backboard.

4 Claims, 10 Drawing Sheets

TENNIS BACKBOARD

This application claims priority as a continuation-in-part application from U.S. patent application Ser. No. 11/445,852, filed Jun. 3, 2006 now U.S. Pat. No. 7,677,993, which claims priority from U.S. provisional patent application Ser. No. 60/688,582, "Tennis Backboard," filed Jun. 8, 2005, both of which are incorporated by reference.

BACKGROUND

A tennis backboard is a useful tool to enjoy some tennis when a player cannot find a partner. A backboard is also a good practice tool for a player to improve his or her skills. Hitting against a backboard can also be good exercise.

However, backboards are heavy and immobile. They are very large and therefore not suited for home use. It also requires a fairly high level of tennis skill to keep a rally against a backboard going for more than a few shots. This limits the usefulness of a backboard for a player to "groove" her shots. The track of a ball bouncing off a backboard also typically is lower than a ball in a rally, resulting in a lower bounce than a player gets in a real match, which impairs the usefulness of the backboard for practice.

New tennis training devices are needed. Preferably, a new training device would be suited for home use and easily moved. Preferably a new training device would facilitate long consecutive rallies by players and help players develop consistent strokes. Preferably, a new training device would be easier for beginning players to use.

SUMMARY

The invention provides a new tennis backboard design. The backboard includes a firm backing layer underlying a soft deadening layer. The rebound of a tennis ball from the backboard is reduced as compared to rebound from a rigid hard-surface backboard. This allows a player to stand fairly close to the backboard, which reduces misses. The player can stand fairly close and hit balls hard against the backboard. Because the rebound is reduced, the ball simply bounces back softly and easily to the player, allowing the player to hit hard again from a fairly short distance. Thus, long rallies without missing are easily achieved. The ball tends to come back to the same spot, allowing a player to hit the same shot with the same form over and over again. This makes for excellent practice where a player can really "groove" his or her strokes. Since long rallies are so easy, hitting against this backboard is also excellent exercise. Rallies tend to be limited only by the player getting tired, instead of by missing the board or the ball bouncing away.

Since the bounce is reduced, the player can stand closer to the backboard, and therefore the backboard can be smaller than conventional backboards without the player missing the backboard. This allows the backboard to be light, portable, and easily stored. Because of the addition of a soft deadening layer, the firm backing layer of the backboard can also be thin and made of lighter and weaker material than a conventional backboard, reducing the weight of the backboard.

Thus, one embodiment of the invention provides a tennis training apparatus comprising: (a) a backboard comprising (i) a firm backing layer underneath (ii) a soft deadening layer comprising a resilient polymer foam layer that is at least 2 inches thick, the resilient polymer foam layer having a top, bottom, left, and right edge, and (iii) a flange coupled to the firm backing layer and located above, below, to the left, and to the right of the foam layer; mounted on (b) a stand. Rebound of a tennis ball from the backboard is reduced as compared to rebound from a rigid hard-surface backboard. The apparatus is portable. Excluding any detachable weights added to provide stability, the apparatus weighs less than 100 pounds and can be moved by being carried by one adult of average strength without tools. The stand comprises a plurality of legs, the backboard has a top and a bottom edge and a right and a left edge, and the backboard is mounted on the stand such that the bottom edge of the backboard is 2.5-4.0 feet above the ground. The backboard further comprises a fabric cover having a perimeter and having a cord attached to the fabric cover around the perimeter, the fabric cover overlying the resilient polymer foam layer with the cord cinched behind the flange above, below, to the right, and to the left of the foam layer.

Another embodiment of the invention provides a tennis training apparatus comprising: (a) a backboard comprising (i) a firm backing layer underneath (ii) a soft deadening layer comprising a resilient polymer foam layer that is at least 2 inches thick; mounted on (b) a stand. Rebound of a tennis ball from the backboard is reduced as compared to rebound from a rigid hard-surface backboard. The apparatus is portable. Excluding any detachable weights added to provide stability, the apparatus weighs less than 100 pounds and can be moved by being carried by one adult of average strength without tools. The firm backing layer is composed primarily of plastic, has a back surface and a front surface, and has protruding ribs formed on its back surface that enhance rigidity of the plastic firm backing layer.

Another embodiment of the invention provides a kit for building a tennis training apparatus, the kit comprising: (a) one or more pieces of resilient polymer foam; (b) a fabric cover; (c) one or more support pieces adapted to be attached to a firm backing layer and to support the foam pieces so that they rest against the firm backing layer; and (d) connectors for connecting the firm backing layer to a stand; wherein the firm backing layer, foam, and fabric cover form a backboard, and the backboard is attached to a stand to form a tennis training apparatus; and wherein the kit does not contain the firm backing layer or stand.

One embodiment of the invention provides a tennis training apparatus that includes a backboard having (i) a firm backing layer underneath (ii) a soft deadening layer; wherein rebound of a tennis ball from the backboard is reduced as compared to rebound from a rigid hard-surface backboard. Preferably the backboard is mounted on a plurality of legs in the apparatus. Preferably the apparatus is portable. Preferably, the apparatus weighs less than 100 pounds and can be carried by one adult of average strength without tools.

DETAILED DESCRIPTION

Definitions

Figure 1A:
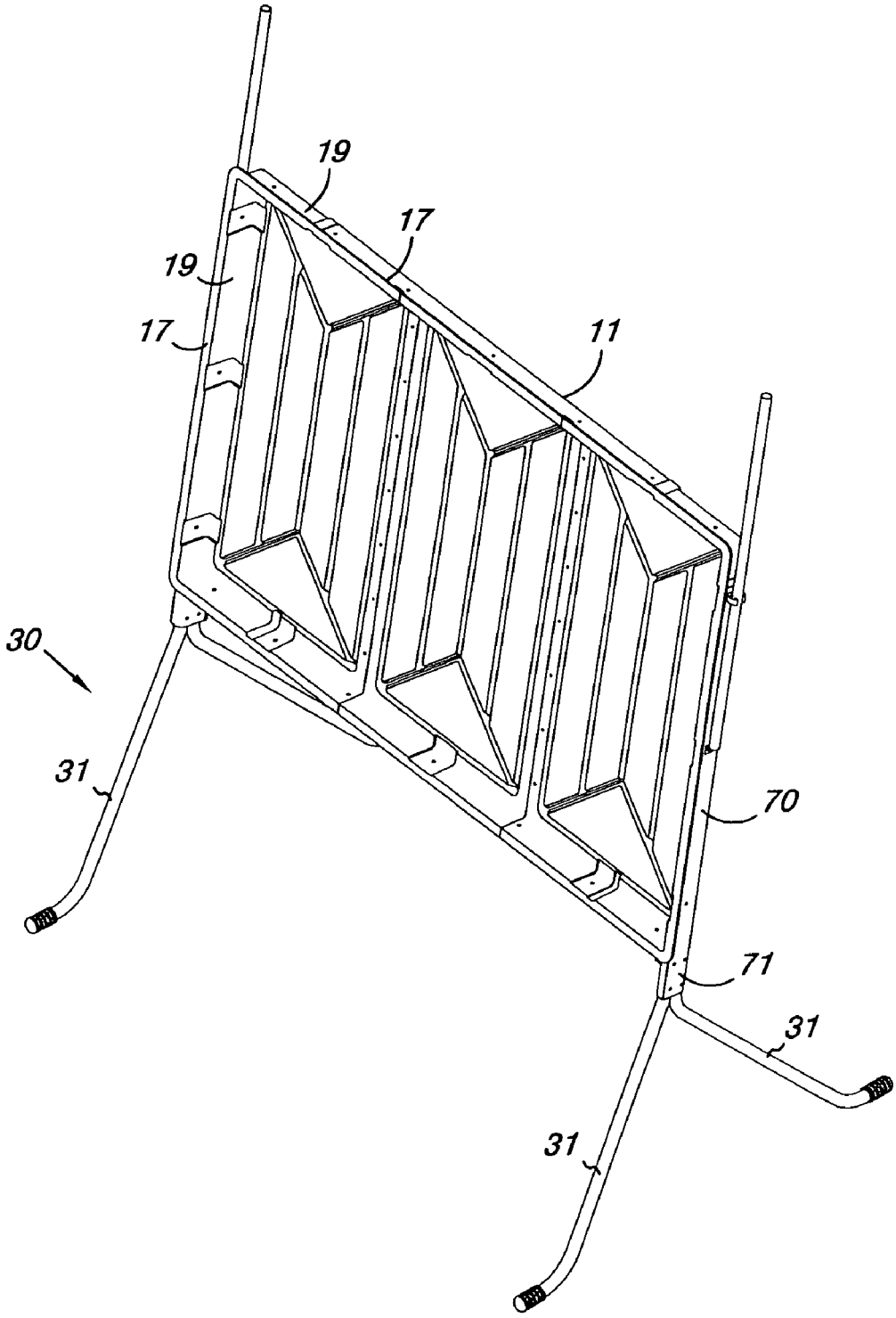
FIG. 1A shows the firm backing layer, flange, and stand of a tennis training apparatus of the invention.

The term "portable" as used herein means able to be moved by one adult of average strength without tools, either by carrying, dragging, or rolling. An apparatus is considered portable herein if it weighs less than 120 pounds, or if it weighs less than 200 pounds and has wheels or low-friction gliders that can be used to roll or slide the apparatus.

Description

The invention provides a tennis backboard and an apparatus involving a tennis backboard mounted on legs. A tennis training apparatus 1 of the invention that includes a tennis backboard 10 of the invention mounted on the legs 31 of a stand 30 is shown in FIGS. 1A-6C. The backboard includes a firm backing layer 11 underlying a soft deadening layer 12.

The firm backing layer and soft deadening layer can be any suitable materials such that an appropriate rebound of a struck tennis ball is provided by the backboard. An appropriate rebound is a rebound that carries the tennis ball a distance at which a player can conveniently hit the ball repeatedly against the backboard. The ball rebounds a lesser distance than it would from a conventional rigid hard-surface backboard. Preferably the rebound carries the ball a distance such that the player can stand less than about 30 feet from the board to engage in a ground-stroke rally with the board (i.e., a rally wherein the player hits the ball on one bounce). Preferably, the rebound carries the ball a distance such that the player can stand about 12 to about 25 feet from the board to engage in a ground-stroke rally with the board. For a player to stand a given distance from the board in a ground-stroke rally, the ball would rebound to bounce on the ground about ⅔ to ¾ of the distance from the board that the player should stand.

The firm backing layer can be composed of any suitable material such that the firm backing layer provides adequate support to the soft deadening layer to give a consistent and appropriate rebound of the tennis ball from the backboard. For instance, it can comprise wood, fiberglass, plastic, or metal, or a combination thereof.

In a particular embodiment, the firm backing layer is an open mesh. By open mesh, it is meant that the firm backing layer has spaces that pass through it. For instance, it has been found that chicken wire is an adequate firm backing layer, particularly if supported by more rigid frame member behind it.

The firm backing layer can be a rigid or semi-rigid layer of, for instance, wood, metal, fiberglass, or plastic. By semi-rigid it is meant that the layer may flex. The firm backing layer can be much thinner and less rigid than a conventional tennis backboard. This is so particularly because the soft deadening layer absorbs much of the impact force of a tennis ball directed at the backboard and lessens the impact force on the firm backing layer.

The firm backing layer may also be or include a fabric mounted on a frame. The fabric should be held at least moderately taut on the frame. In one embodiment, the fabric consists of interlaced straps, such as that found in a folding outdoor lawn chair.

The firm backing layer is beneath the soft deadening layer. By this it is meant that the soft deadening layer forms the surface that is struck by the tennis ball or is closer to the surface that is struck by the tennis ball than the firm backing layer.

In a preferred embodiment, the soft deadening layer includes a polymer foam, such as polyurethane foam. A particularly preferred embodiment is a 2-4 inch layer of open-cell standard firmness polyurethane foam.

A particularly preferred foam has a density of less than 2.5 lbs/ft$^3$. We have used an open-cell polyurethane foam with a density of approximately 1.45 lbs/ft$^3$. A preferred foam has a compression number of less than 45. The compression number is a standard measurement used in the foam industry that is also known as the inertial load deflection measurement. It is the amount of weight in pounds needed to compress a 4-inch thick piece of foam to 3 inches of thickness. In the test, the foam is a 15 inch by 15 inch square and the weight to compress it is a cylinder with a 15 inch radius. We have used a foam with a compression number of about 33.

An open-cell polyurethane with a density of less than 2.5 lbs/ft$^3$ and a compression number of less than 45 that is 2-4 inches thick (preferably 3-4 inches thick) allows the tennis ball to embed in the foam, and then be thrown back by the rebound of the foam. Thus, the ball does not come back due to the intrinsic rebound of the ball as it would on a solid wall, where the balls deforms and then reforms as it rebounds from the wall. Rather, it is the deformation and reformation of the foam that accounts for the rebound. This results in a rebound distance that is very similar (almost the same) regardless of how hard the ball is hit. It also results in a rebound direction that tends to be close to a perpendicular to the plane of the hitting surface of the backboard. That is, if a ball is hit at an angle from the right, it tends to come relatively straight out from the backboard, rather than rebounding at an equal angle toward the left. All three factors of thick foam, low weight density foam, and a low compression number foam contribute to these rebound characteristics.

Thus, in some embodiments, the soft deadening layer comprises a resilient polymer foam layer at least 2 inches thick, or at least 3 inches thick. In some embodiments, the soft deadening layer comprises resilient polymer foam with a compression number of less than 50, less than 45, less than 40, or less than 30. In some embodiments, the resilient polymer foam has a density of less than 3.0, less than 2.5, or less than 1.8 pounds per cubic foot. A low foam density also has the advantage of reducing the weight of the apparatus, making it more portable.

In some embodiments, the rebound of a tennis ball from the backboard is due to resilience of the foam and is not dependent on the intrinsic bounce of the ball. When this is the case, then the backboard or apparatus produces an equivalent rebound when struck with a tennis ball at 60 mph and when struck with a rigid ball of the same shape, size, and weight as a tennis ball at 60 mph, where the rigid ball does not bounce the same as the tennis ball against a rigid surface. As described above, the advantages of this are that the rebound distance is similar regardless of how hard a tennis ball is hit into the backboard, and the direction of the rebound also tends to be similar regardless of the angle of impact.

The soft deadening layer can be other types of polymer foam, such as neoprene or cross-linked polyethylene. These are typically closed cell foams. An open-cell foam is typically less dense and more easily deformed than a closed cell foam and performs better in the backboard. However, one disadvantage of open-cell foams is that they absorb water. Closed-cell foams are advantageous for outdoor use in not absorbing water. One particularly preferred type of closed cell foam is a drain-through foam. These are closed-cell foams that are formed into an open lattice work through which water can drain. The lattice work compresses on impact, so that drain-through foams are more easily compressed than other closed-cell foams. They thus can have compression and rebound properties more similar to open-cell foam while also having the advantage of being waterproof.

The soft deadening layer in a particular embodiment comprises a waterproof material, e.g., a waterproof foam.

In a particular embodiment, the soft deadening layer is waterproof. In another embodiment, it does not absorb water (e.g., water may run through it without being absorbed). In other embodiments, the soft deadening layer does absorb water.

In a particular embodiment, the soft deadening layer comprises an air bladder. This can be similar to an air mattress. It can be composed of a flexible airtight material forming a bladder inflated with air. The bladder may be in some embodiments approximately 1-4 inches thick.

In a particular embodiment, the soft deadening layer comprises fibrous polymer fill. The polymer can be natural or synthetic, e.g., cotton or polyester. For instance, the fibrous polymer fill can be cotton or polyester quilt batting.

In particular embodiments, particularly where the soft deadening layer absorbs water, the backboard may include a fabric cover 13 (FIGS. 2 and 5B) mounted over the soft deadening layer. The tennis ball in this case would strike the fabric cover. The fabric cover may be waterproof, particularly if the soft deadening layer absorbs water. Foam is typically sold in 2×6 foot pieces. Thus, to cover a backboard area of, e.g., 4×6 feet, at least two pieces of foam are needed. Smaller pieces of foam are also easier and cheaper to ship than larger pieces. But if the soft deadening layer is composed of separate pieces of foam, without a fabric cover tennis balls that strike at the seam where two separate pieces of foam abut will tend to lodge between the two pieces or at least rebound irregularly. But if the backboard comprises a fabric cover, this problem is entirely avoided. A consistent rebound is obtained even if a ball strikes the fabric cover over a seam between separate pieces of foam.

Thus, in particular embodiments, the soft deadening layer includes two or more resilient foam pieces, the resilient foam pieces having lateral edges and abutting each other along their lateral edges. The lateral edges along which they abut may be oriented horizontally or vertically or another direction. In specific embodiments, especially where the soft deadening layer includes a plurality of pieces of foam, the backboard includes a fabric cover covering the soft deadening layer in use. Preferably, the fabric cover is detachable.

The fabric cover should have good flexibility and should generally fit rather loosely over the soft deadening layer. It has been found with polyurethane open cell foam as the soft deadening layer that if the fabric is stiff or fits too tautly, the ball rebounds off the fabric without embedding in the foam. The ball in this situation tends to rebound at too high an angle and not far enough from the backboard.

Polyester fleece provides a good fabric cover that prevents balls from lodging in the seam between separate pieces of foam, and slightly adds to the deadening of the rebound.

A lightweight nylon ripstop (e.g., 1.9 oz. per sq. yard) also has adequate flexibility to be a good fabric cover. If it is polyurethane coated, it is also waterproof, which is important to keep a water-absorbent deadening layer dry.

The apparatus may also include a further durable waterproof cover to cover the backboard when not in use, to keep the backboard, including other fabric covers used in the backboard, dry and protected from the sun. The durable outer waterproof cover may be vinyl, for instance. This durable waterproof cover is generally removed for use, but may optionally be left on for use. If the vinyl cover is left on, the ball rebounds at a higher angle and bounces a shorter distance from the backboard. This may be suitable for some players who want to stand at a closer distance from the backboard.

Figure 4:
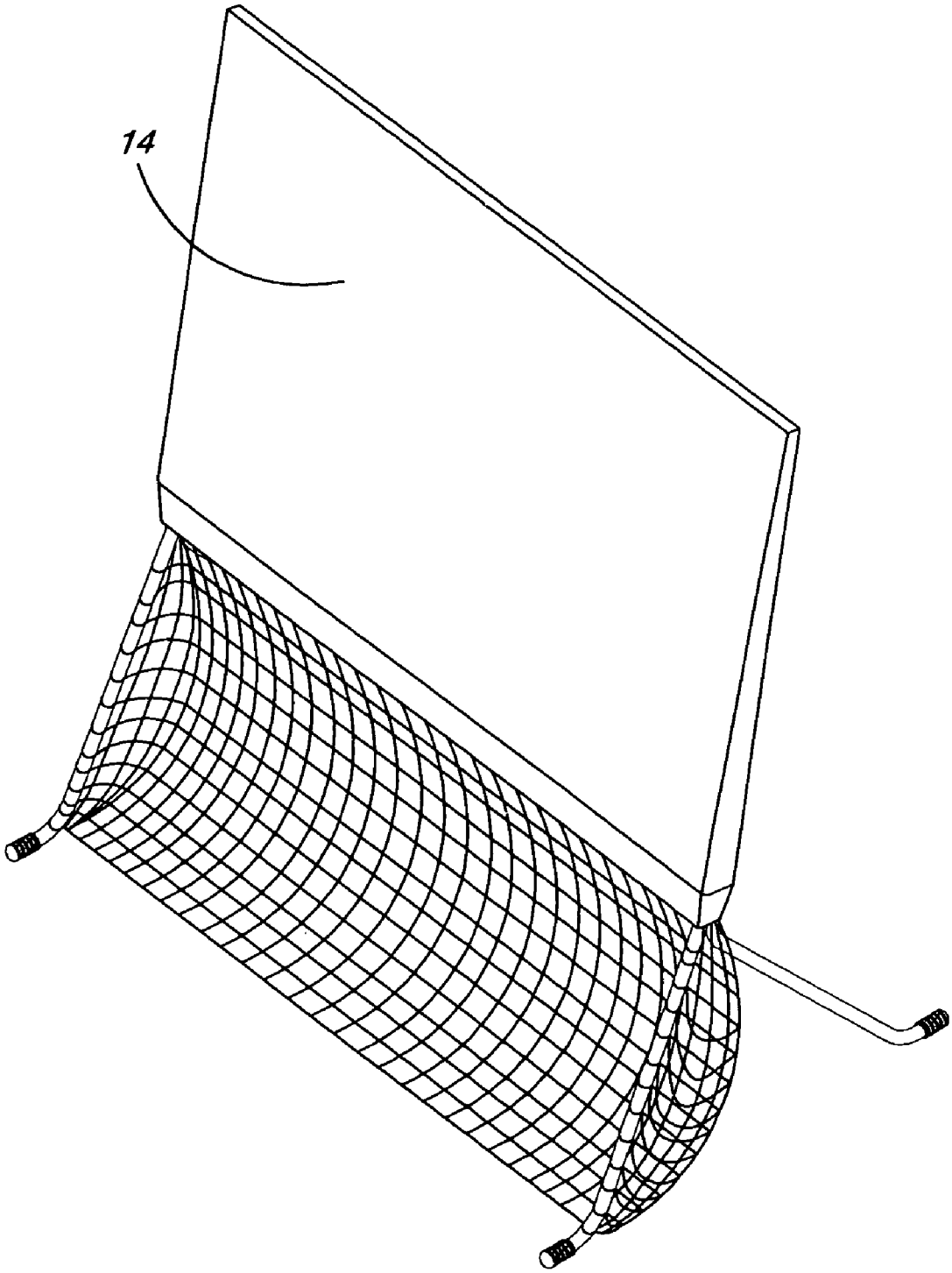
FIG. 4 shows one embodiment of a tennis training apparatus of the invention with a rain cover.
Figure 6A:
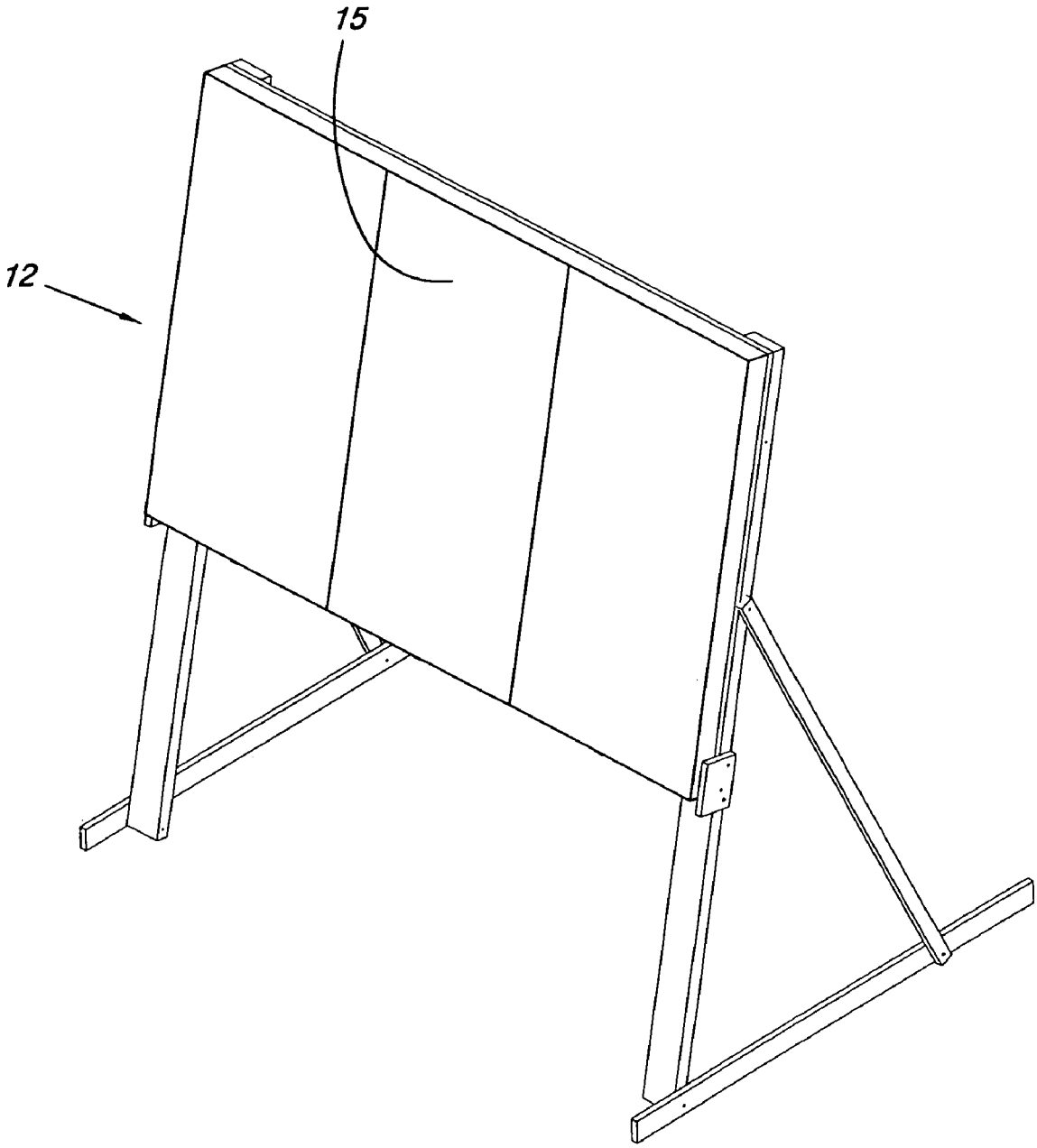
FIG. 6A shows an apparatus with foam pieces.
Figure 6B:
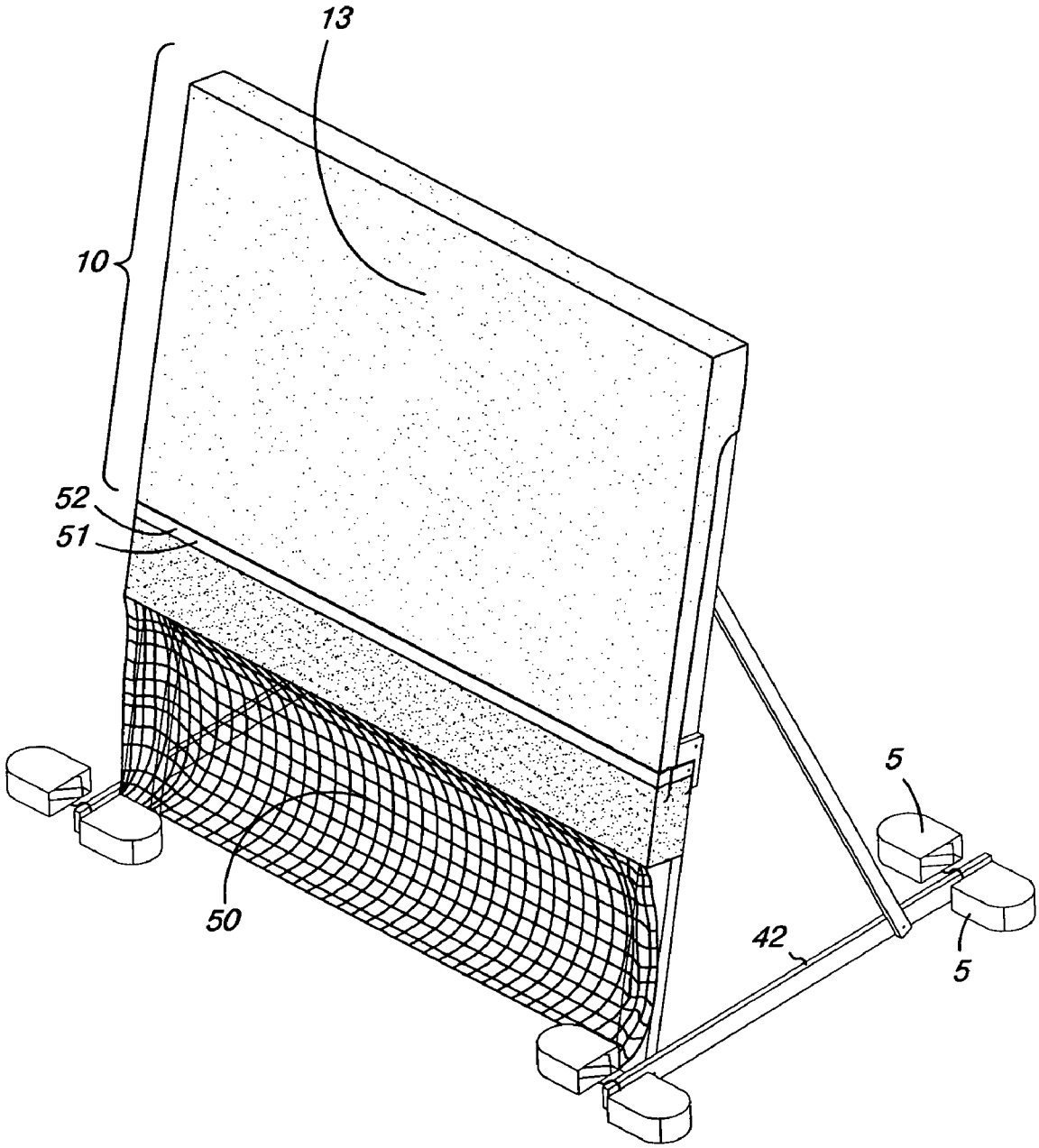
FIG. 6B shows one embodiment of a complete tennis training apparatus of the invention assembled from a kit.
Figure 6C:
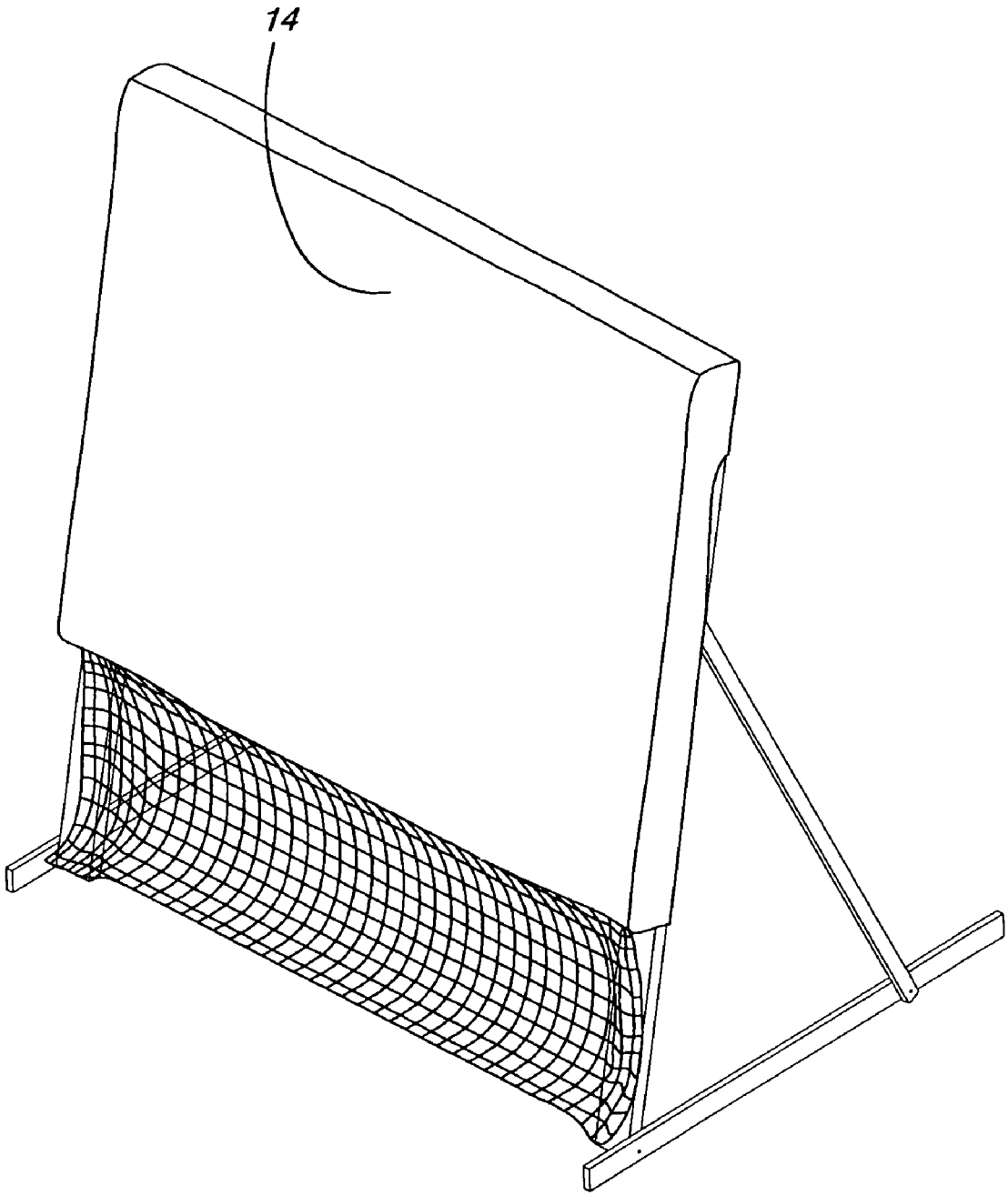
FIG. 6C shows a tennis training apparatus of the invention assembled from a kit with a rain cover.

The fabric covers may be sewn to form a cap on their upper edges that fits over the upper edge of the backboard. Thus, the fabric covers hang from the upper edge of the backboard (FIGS. 4, 6B and 6C).

In specific embodiments, the soft deadening layer of the backboard comprises resilient polymer foam that is detachable from the firm backing layer. It is preferable that the foam be detachable for convenient breakdown and storage of the apparatus. It is especially preferable that the foam be detachable if the foam is an open-cell foam that absorbs water, so that it can be removed to dry or clean in the event that it gets wet. Detachable foam may be held in place by gravity as the foam pieces rest against a backward leaning firm backing layer and on top of a lower shelf or support pieces 33 at the bottom edge of the firm backing layer. It can also be held in place by a combination of these factors.

In particular embodiments, the backboard is rectangular in shape and 3 to 8 feet tall and 4 to 12 feet wide. In particular embodiments, the backboard is rectangular in shape and 4 to 6 feet tall and 4 to 8 feet wide. In particular embodiments, the backboard has an area of no more than 40, 35, 30, or 25 square feet.

Preferably the backboard has a top edge, a bottom edge, a right edge, and a left edge (which may be curved or straight and may not be oriented perfectly vertically or horizontally), and the distance between the top and bottom edges is at least 3.5 feet at the tallest point, and the distance between the right and left edges is at least 3.5 feet at the widest point. These dimensions are generally necessary to provide a large enough target for players of average skill to consistently hit the backboard.

Preferably the apparatus is small enough and light enough to be movable. In particular embodiments, the apparatus weighs less than 100 pound, less than 70 pounds, or less than 50 pounds. These weights are light enough to allow most adults to move the apparatus without the help of a second person. In some embodiments, the apparatus includes detachable weights 5 that mount on the apparatus to stabilize the apparatus against tipping over in the wind, e.g., on feet of a base or on a stand. The weight of these detachable weights is not included in the weight limits listed here.

The backboard 10 is supported on a stand 30 shown in FIGS. 1A, 2B, 5, and 6B. If the backboard is supported so that the bottom edge of the backboard is 3 to 3.5 feet off the ground, the bottom edge is at the regulation height of a tennis net, which is 3 feet high in the center of the court and 3.5 feet at the outer ends. This is a convenient height, and holding the backboard at this height helps train the player to hit the ball over the net. Mounting the backboard so it does not extend all the way to the ground also reduces the needed weight of the backboard. The bottom edge of the backboard at approximately net height also provides a convenient handle with which to hold and carry the apparatus.

Thus, one embodiment of the invention provides an apparatus 1 comprising a tennis backboard 10 mounted on a stand 30. The stand 30 comprises two or more legs 31. The backboard 10 is typically attached to the stand 30, but in some embodiments it could be mounted on the stand by resting on the stand, connected only by gravity.

In particular embodiments, the backboard has a top and a bottom edge and a right and a left edge, and the backboard is mounted such that the bottom edge is about 2.5-4.0 feet above the ground, preferably 3.0-3.5 feet above the ground.

In particular embodiments, the backboard is permanently or semi-permanently mounted on the legs. Permanent or semi-permanent mounting could be, for instance, by means of rivets or nuts and bolts.

In other embodiments, the backboard is detachably mounted on the legs. For instance, it may simply rest by gravity on a stand supported by the legs. The backboard may also be attached to the legs, or the stand supported by the legs, by means of quick-release clamps or bolts and wing nuts designed to be quickly detached by hand.

The stand holding the backboard may be free standing and movable, or it may lean against a permanent structure, such as a house or garage. The legs of the stand may also be permanently mounted in the ground, or attached to a structure mounted in the ground, such as fence posts for a public tennis court, if the apparatus is not portable.

The backboard may be mounted on the legs in a vertical position. It also may be mounted at a backward angle of 1 to 45 degrees relative to a perpendicular to the ground, more preferably 5 to 30 degrees, most preferably about 10 degrees relative to a perpendicular to the ground. With a backward angle, the backboard will rebound a struck tennis ball at a higher trajectory than a vertical backboard. This can be advantageous. From a vertical backboard, a ball tends to come back with a lower trajectory than does a ball in a rally between two players on a court. Mounting the backboard at a backward angle causes the ball to rebound at a higher trajectory and drop to the player from a greater height than does a ball rebounded from a conventional backboard. This trajectory of the ball is somewhat more realistic in reproducing the experience of a rally in a tennis match. If a conventional rigid hard-surface backboard were mounted with a backward lean, the ball would tend to ricochet so high and far that it would be impossible to sustain a rally. But with the deadening layer of the present backboard, the rebound of the ball is reduced so that the backboard launches a rebounded ball at a comfortable and realistic arc that drops the ball a relatively short distance from the backboard. Thus, the player can easily sustain a long rally against the backboard even, or especially, when the backboard is mounted with a backward lean. A preferred backward lean is 5-30° from a perpendicular to the ground, more preferably about 10°.

Another advantage of mounting the backboard at a backward lean is that then gravity can be used to hold the soft deadening layer in place. For instance, open-cell polyurethane foam 2-4 inches thick can be used for the soft deadening layer. If the backboard leans backward, these can be held in place by resting by gravity on the firm backing layer and on a shelf or support pieces at the lower edge of the backboard. Foam this thick has enough strength to hold its shape so that it can stand upright and be held by gravity leaning against the firm backing layer, as is shown with foam pieces 15 resting against firm backing layer 11 in FIGS. 1A, 2A, 5, and 6A. Foam 2-4 inches thick is also strong enough to be supported by the support pieces 33 in FIG. 5. A thinner layer of foam lacks the strength to hold a flat shape. Thus, it ordinarily cannot be detachable and must be attached to the firm backing layer, for instance by gluing, in order for it to stay in place. That is another advantage of using foam at least 2 inches thick.

In a particular embodiment of the invention, the soft deadening layer is a layer of a resilient foam at least 2 inches thick.

In a particular embodiment of the backboard, the soft deadening layer is a closed cell foam.

In a particular embodiment of the backboard, particularly where the soft deadening layer is closed cell foam, the backboard does not have a waterproof cover or film covering the soft deadening layer.

Where the soft deadening layer is or comprises foam, and especially particularly open cell foam, the foam in general does not have an adherent waterproof film or adherent waterproof fabric bonded to the foam. An adherent waterproof film or adherent waterproof fabric tends to interfere with the rebound properties of the backboard and prevent balls from embedding in the foam and rebounding straight out from the foam. Instead, the balls fail to embed in the foam and tend to rebound at an upward angle that is often excessive.

In a particular embodiment, the soft deadening layer is detachable. That is, it can be removed by hand. It is not glued to the backing layer, or attached by permanent or semi-permanent fasteners.

Preferably, the apparatuses of the invention are free standing. The apparatus may alternatively be adapted to lean against a structure such as a house or garage.

In one embodiment of the apparatus involving a backboard mounted on a stand comprising a plurality of legs, the stand contacts the ground at least three points covering a depth of at least 3 feet forward-to-back (in the direction perpendicular to the surface of the backboard), and the apparatus is free-standing. Examples of this are shown in the FIGS. In FIGS. 5-6C the backboard 10 is mounted on legs 31 and the legs are supported by two parallel feet 42 and cross braces 43. The feet contact the ground and are at least 3 feet long. The feet are preferably 4-6 feet long. The legs 31, feet 42, and cross braces 43 collectively constitute a "stand" 30, as the term is used herein.

In particular embodiments, the backboard is detachable from the base.

In particular embodiments, the apparatus includes one or more stabilizing weights detachably coupled to the base or stand to stabilize the apparatus. For instance, in FIG. 6, detachable weights 5 are placed over the ends of each of the two feet 42 to stabilize the apparatus, particularly to stabilize it against overturning in high winds. The detachable weights may be, for instance, sand bags, saddle bags holding one or two bricks on each side of the saddle bag, or a molded piece filled with water, sand, or gravel. The detachable weights are preferably light enough to be conveniently removed when a user wants to move the apparatus, e.g., less than 50 pounds or less than 25 pounds each.

In some tennis backboards, the backboard has an opening to serve as a target and capture balls hitting the opening in the backboard, or an opening through which balls are fired by a ball machine from the backboard. The present apparatus does not generally have these features. The apparatus generally does not have an opening in the fabric cover or soft deadening layer of the backboard or the firm backing layer to allow struck balls to pass through or be captured.

FIGS. 1-4 show one embodiment of a tennis training apparatus 1 of the invention. Firm backing layer 11 is shown. In the embodiment shown in FIG. 1, the firm backing layer 11 is plastic, and is formed as one piece coupled to walls 19 and a flange 17 on the perimeter of the firm backing layer. The walls 19 are at right angles to the firm backing layer 11, and the flanges 17 are at right angles to the walls 19 and parallel to the firm backing layer 11. These changes of angles help to provide structure and strength to the firm backing layer. The flange 17 also serves as an attachment for a fitted fabric cover 13 with a cord 14 attached to the fabric cover about the perimeter of the fabric cover shown in FIG. 2B. The cord 14 may be, for instance, sewn into a hem of the fabric cover or attached to the perimeter of the fabric cover by loops sewn to the cover. The cord 14 of the fabric cover 13 fits around and behind the flange 17 to hold the fabric cover onto the backboard 10.

In FIG. 1A, steel side rails 70 are also shown attached to the backboard and these rails contain receptacles 71 for legs 31. The legs 31 are coupled to the backboard 10 through attachment to receptacles 71.

Figure 1B:
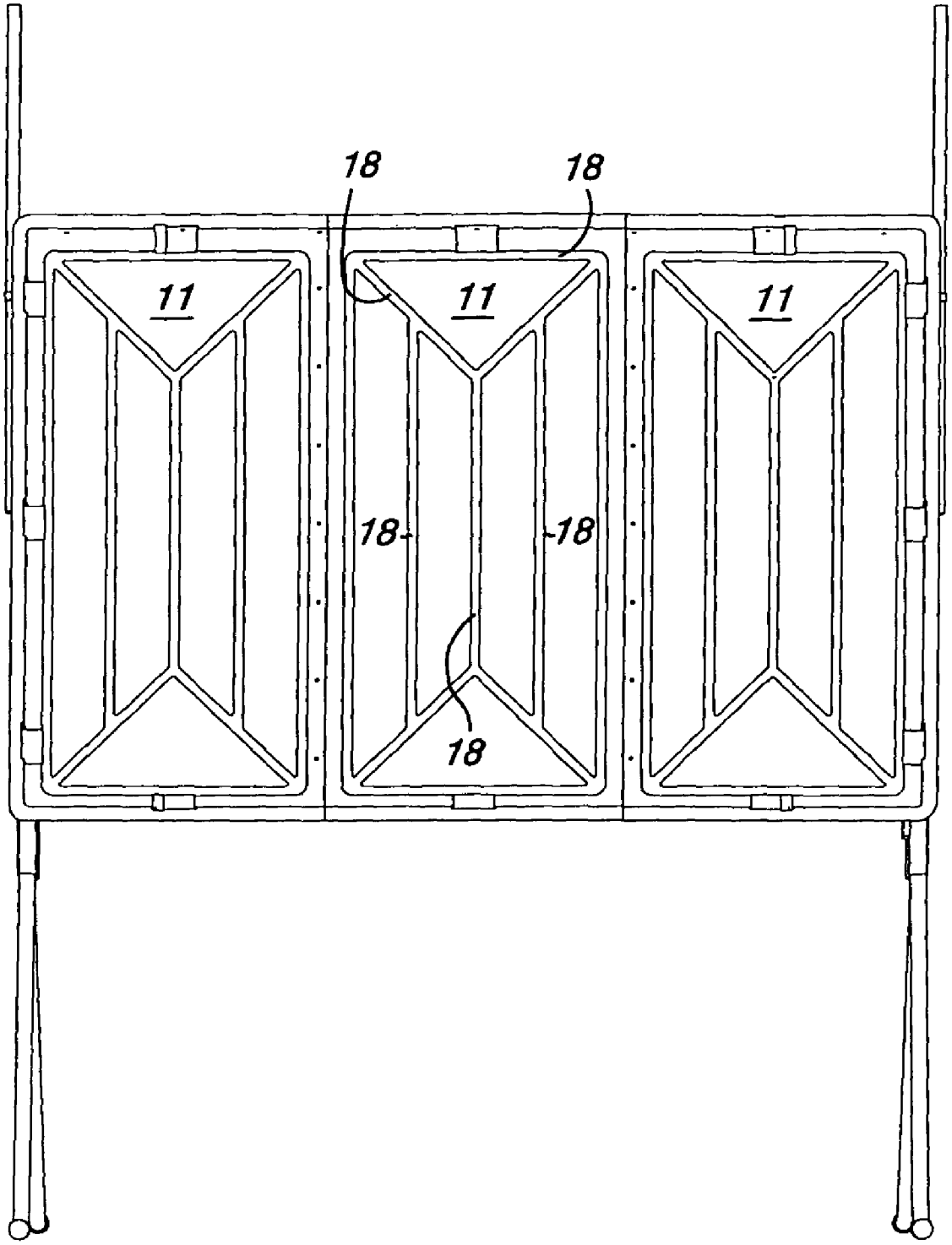
FIG. 1B shows a back view of one embodiment of the apparatus showing supporting ribs in the firm backing layer.

In FIG. 1B the backing layer 11 is shown with ribs 18. The ribs are formed into the plastic of the backing layer to give it enhanced rigidity and strength. This allows thinner and weaker plastic than would otherwise be possible, reducing the weight of the apparatus and making it more portable.

Figure 2A:
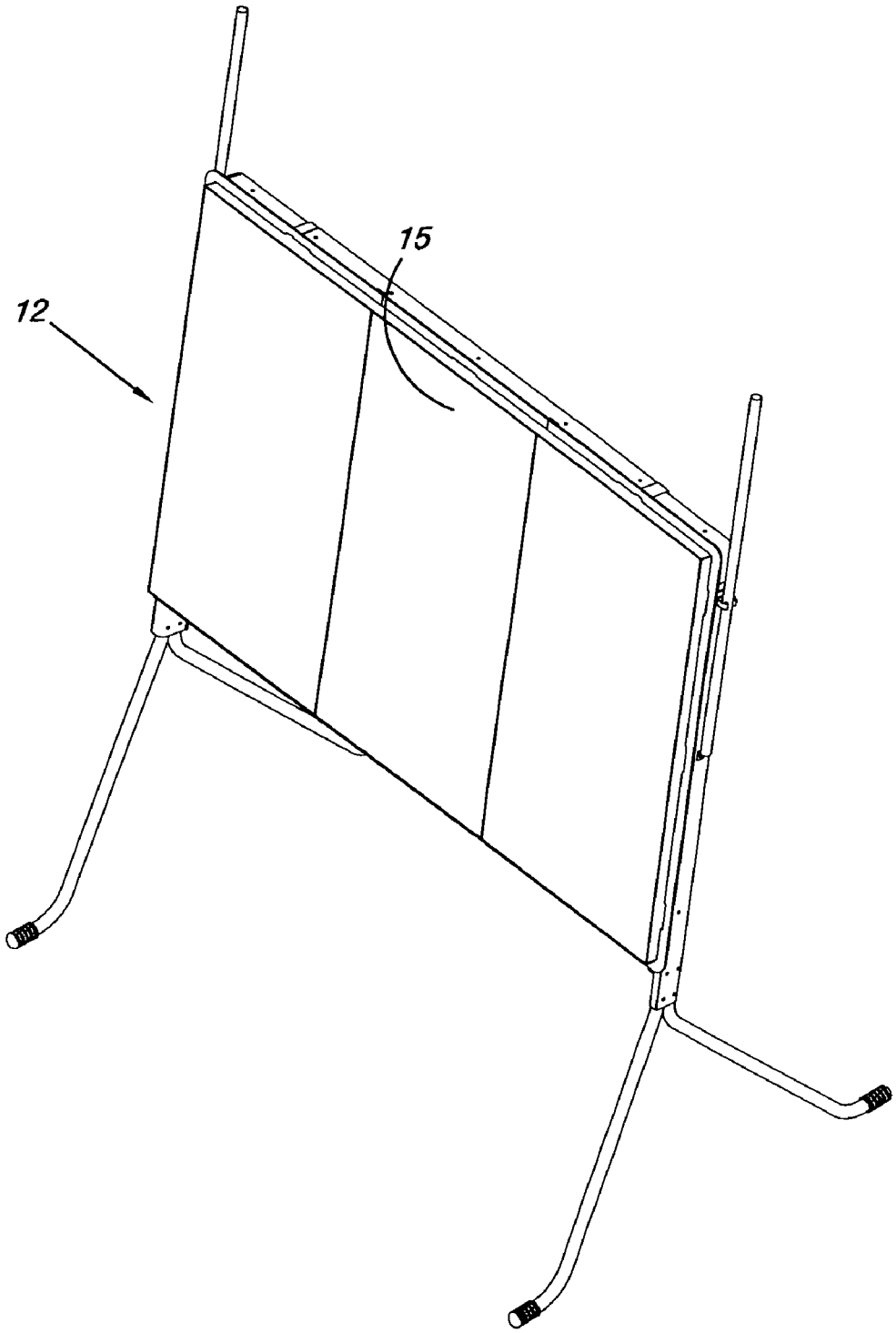
FIG. 2A shows an apparatus with foam pieces.

In FIG. 2A foam pieces 15 are shown resting against the firm backing layer 11 standing on the lower wall 19. The soft deadening layer 12 comprises the foam pieces 15. The fabric cover 13 in FIG. 2B overlays the foam pieces 15.

Figure 2B:
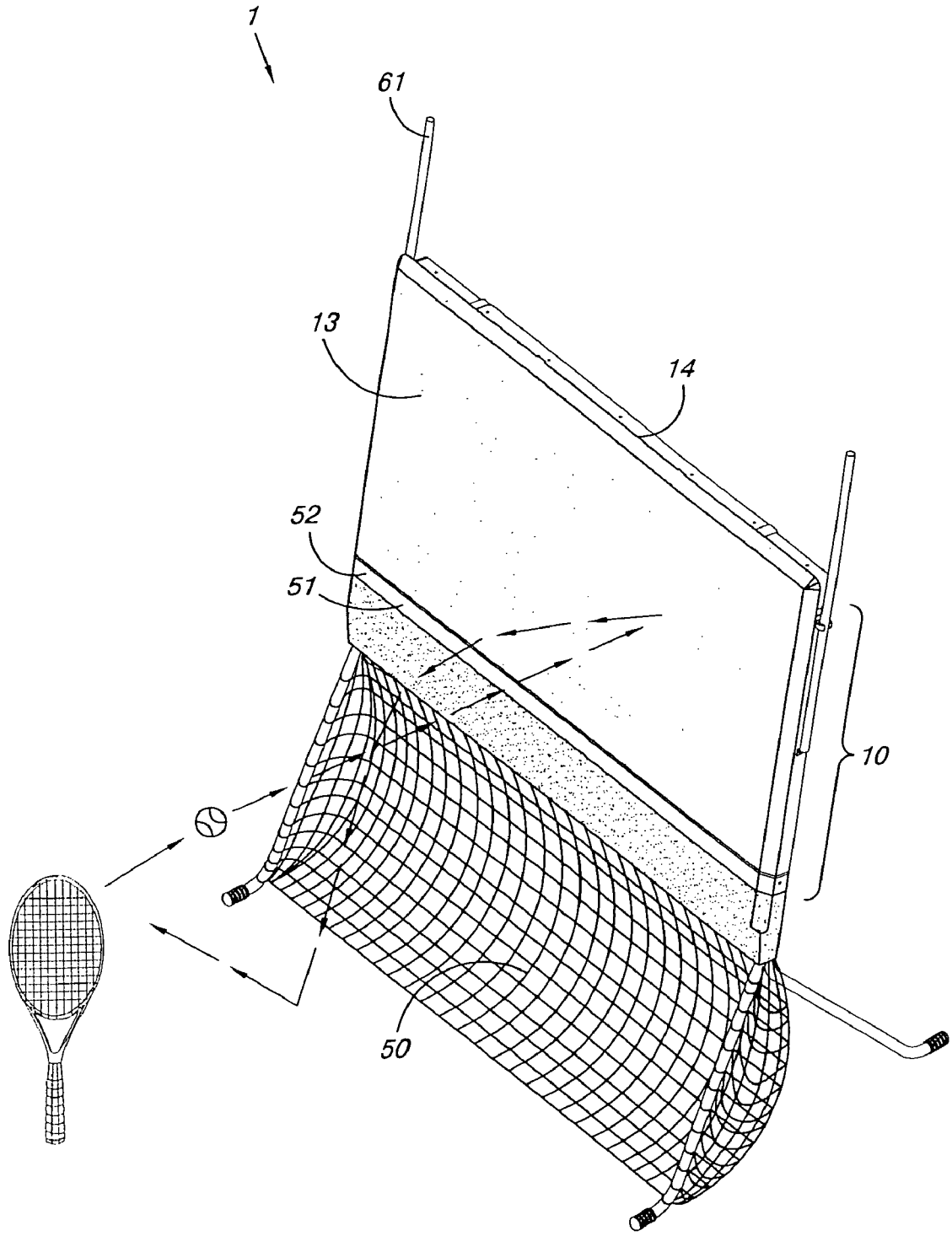
FIG. 2B shows one embodiment of a complete tennis training apparatus of the invention.

A lower net 50 is shown in FIG. 2B. It serves to catch misses below the backboard. In FIG. 2B, the upper edge of the lower net 50 is a solid white band 51, so the lower net resembles a tennis net. The solid band 51 could be other colors than white or could be absent in other embodiments. The lower net is coupled to the firm backing layer by grommets in the ends of the white band, with the grommets fitting over a bolt through the walls 19 of the backboard 10. In a preferred embodiment, the white fabric band 51 includes an elastic band 52 that serves to keep the upper edge of the lower net taut. The elastic band, for example, may be sewn into a fabric pocket where the white fabric band is a fabric pocket.

Figure 3:
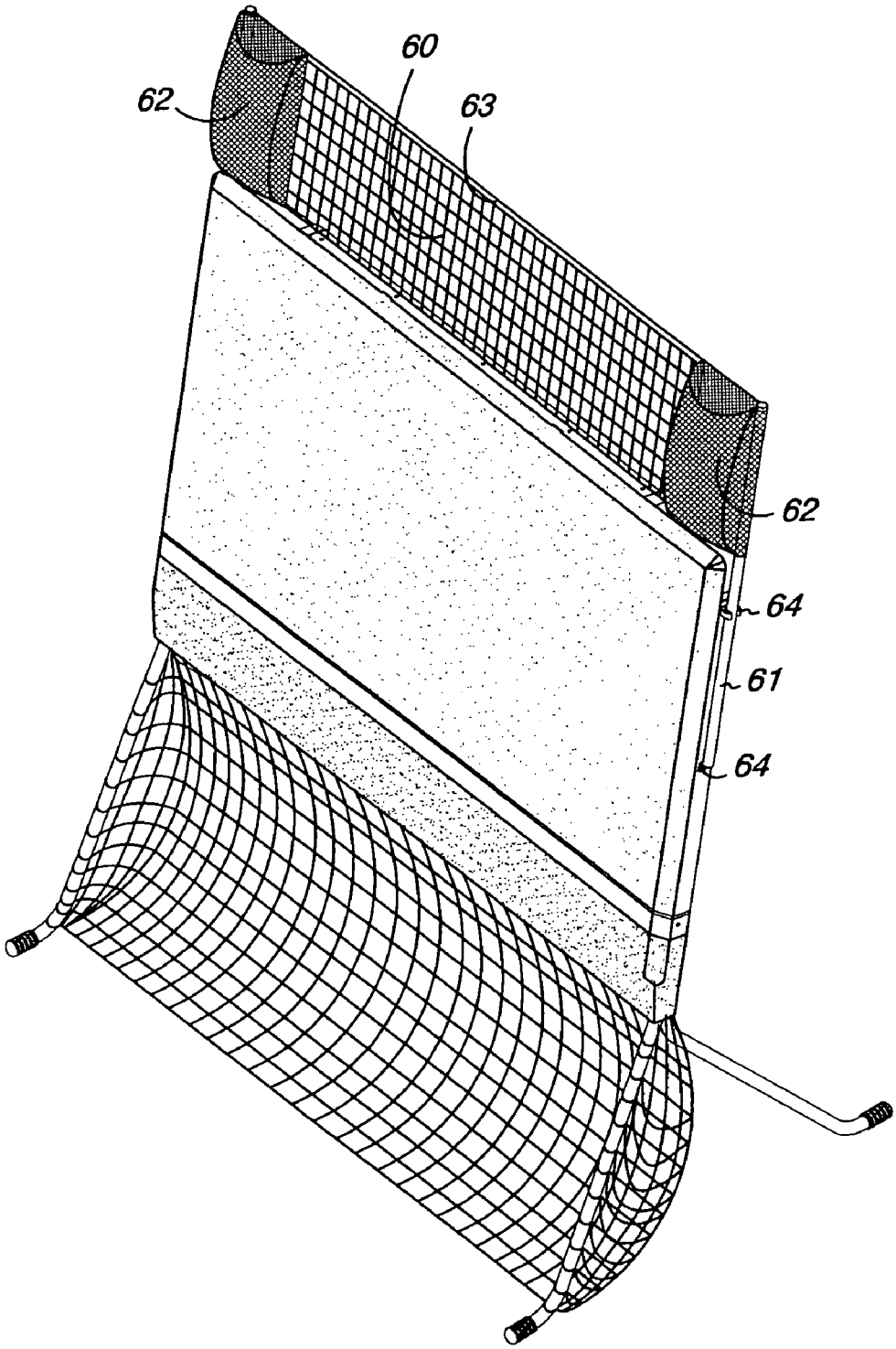
FIG. 3 shows one embodiment of a complete tennis training apparatus of the invention with upper net and lower net.

The tennis training apparatus may also include an upper net 60, as shown in FIG. 3, to catch balls that miss above the backboard. In FIG. 3 the upper net 60 includes fabric pockets 62 on the left and right lateral edges of the upper net adapted to fit over net poles 61. The net poles 61 are held to the backboard by net pole holders 64. The net pole holders 64 can be, in one embodiment, an broom-handle holder that snaps over the upper net pole for the upper net pole holder. A lower net pole holder in one embodiment is a support bracket over which the opening on the lower end of the net pole can fit.

In FIG. 3 the upper net 60 is also shown with an elastic band 63 along its upper edge to hold the upper edge of the net straight across. The elastic can be, for instance, threaded through the holes of netting along the upper edge of the net, and attached to the fabric pocket 62 on its ends.

In FIG. 4 a rain cover 14 is shown. The rain cover can be sewn so its upper edge forms a cap that fits over the top edge of the backboard.

Figure 5:
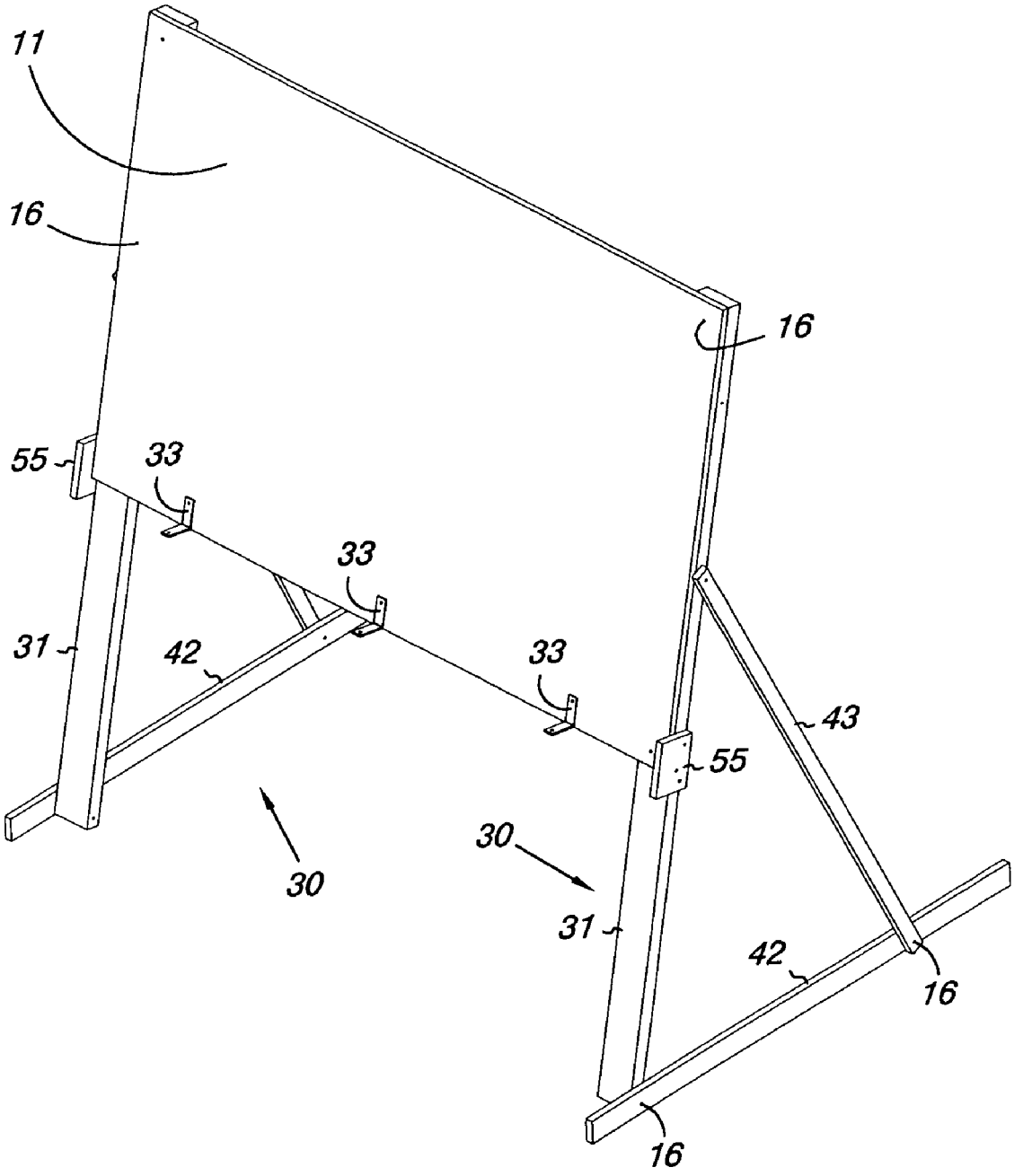
FIG. 5 shows one embodiment of a tennis training apparatus of the invention with firm backing layer and stand.

FIG. 5-6 show a tennis training apparatus that can be assembled from a do-it-yourself kit. The firm backing layer 11 can be a sheet of plywood, e.g., 4 feet×6 feet. The backing layer 11 is attached to legs 31, which are attached to feet 42 and cross braces 43. The legs, feet, and cross braces collectively constitute a stand 30. The pieces are connected by connectors 16, e.g., bolts and nuts and wood screws.

FIG. 5 also shows three support pieces 33 that are connected to the plywood firm backing layer 11. The support pieces may be metal L brackets. The support pieces 33 may also be formed plastic L brackets with a horizontal surface that is the same length as the foam is deep, e.g., 2-4 inches. In one embodiment the support pieces 33 are each about 1 inch wide. In another embodiment 1-5, 2-5, or at least 2 inches wide. The support pieces 33 support three pieces of foam 15 that form a soft deadening layer 12. A fleece cover 13 is sewn with a cap along its upper edge so it can drape over the backboard to cover the foam pieces.

The support pieces 33 should be wide enough to support the foam without the foam deforming around the support piece. But the support pieces do not need to be as wide as the foam and support the entire bottom edge of the foam. We have found that support pieces of 2-5 inches wide are suitable to support a single piece of foam that is 4 inches thick, 4 feet tall, and 2 feet wide.

The apparatus of FIGS. 5-6 is also shown with lower net support boards 55. The lower net support boards 55 are attached to the legs 31 or firm backing layer 11 and serve as a base for the lower net to wrap around to hold the lower net at the front surface of the foam pieces, in front of the foam and in front of the fabric cover 13. Again, the lower net may have grommets in an upper white band 51, which has an elastic in it. The grommets can fit over a bolt through the nut support boards 55 to attach the net to the apparatus near the lower edge of the backboard.

A removable rain cover 14 is also shown. Detachable weights 5 are shown draped over the front and rear ends of each foot 42.

The tennis training apparatus shown in FIGS. 5-6 may be assembled from a kit that includes one or more pieces of resilient polymer foam, a fabric cover (e.g. fleece) to cover the foam pieces in use, one or more support pieces adapted to be attached to the firm backing layer and to support the foam pieces so that they rest against the firm backing layer, and connectors for connecting the firm backing layer to the stand. The kit preferably does not contain the firm backing layer or the stand. But in alternative embodiments, the kit may include the firm backing layer but not the stand, or the stand but not the firm backing layer. The kit typically includes assembly instructions directing the user to purchase, e.g., a sheet of plywood for the firm backing layer, and appropriate lumber for the legs, feet, and cross-braces, and net support boards. The instructions indicate the lengths to cut the lumber and the positions to drill holes for the connectors.

Thus, in one embodiment of the apparatus the firm backing layer is composed primarily of plastic, has a back surface and a front surface, and has protruding ribs formed on its back surface that enhance rigidity of the plastic firm backing layer.

In one embodiment, the apparatus comprises a lower net adapted to be attached directly or indirectly to the legs or firm backing layer and extend below the backboard to the ground to catch missed tennis balls below the backboard.

The net has an upper edge and preferably includes a solid fabric band (preferably a solid white fabric band) along the upper edge. Preferably the solid fabric band includes an elastic band to hold the upper edge of the net taut.

In some embodiments, the apparatus further includes an upper net that is attached directly or indirectly to the firm backing layer and extends above the backboard to catch tennis balls that miss above the backboard.

In some embodiments, the apparatus further comprises two upper net poles, and two or more net pole holders, wherein the net pole holders are attached directly or indirectly to the firm backing layer and hold the upper net poles, wherein the upper net has a left and right lateral edge and an upper edge and a lower edge, the upper net comprises fabric pockets on the left and right lateral edges adapted to fit over the upper net poles, and the upper net comprises an elastic attached along the upper edge of the upper net adapted to keep the upper edge of the upper net taut on the apparatus.

In preferred embodiments of the apparatus, the stand of the apparatus comprises a plurality of legs, the backboard has a top and a bottom edge and a right and a left edge, and the backboard is mounted on the stand such that the bottom edge of the backboard is 2.5-4.0 feet above the ground.

In one embodiment of the kit, the kit comprises a lower net as discussed above adapted to be attached directly or indirectly to the stand or firm backing layer and extend below the backboard to the ground to catch missed tennis balls below the backboard.

In some embodiments of the kit, the kit further includes a detachable rain cover adapted to be removed when the apparatus is in use.

Preferably in the kit, the foam pieces after assembly of the apparatus are detachable from the firm backing layer.

In a preferred embodiment of the kit, the kit includes more than one foam piece, and the foam pieces are adapted to abut each other laterally on the firm backing layer and be covered by the fabric cover in the tennis rebound apparatus, the fabric cover covering the abutment between the foam pieces.

In specific embodiments of the kit, the foam pieces can cover an area of no more than 40 square feet, no more than 35 square feet, or no more than 30 square feet.

In some embodiments of the kit and the apparatus, the first fabric cover is not waterproof, and the kit or apparatus further comprises a second non-waterproof fabric cover adapted to fit over the foam pieces and first fabric cover on the backboard and to decrease the rebound of a tennis ball from the backboard by at least one foot, preferably at least two feet, as compared to the rebound without the second fabric cover. This is a deadening fabric cover that serves to further decrease the rebound so the apparatus can be used in more confined spaces, such as inside a garage. The deadening cover is also useful for players who prefer to stand closer to the backboard, such as beginners who find that they miss the backboard too often if they stand farther away. Reducing the rebound by one foot allows the user to stand approximately two feet closer to the backboard, because the distance traveled by the ball after it bounces on the ground is also reduced by the decreased velocity of the ball.

In other embodiments of the kit, the kit includes a second net that is an upper net adapted to be attached directly or indirectly to the firm backing layer and to extend above the backboard to catch tennis balls that miss above the backboard.

With the upper net, the kit preferably further comprises two upper net poles, and two or more net pole holders, the net pole holders adapted to be attached directly or indirectly to the firm backing layer and to hold the upper net poles, wherein the upper net has a left and right lateral edge and an upper edge and a lower edge, the upper net comprises fabric pockets on the left and right lateral edges adapted to fit over the upper net poles, and the upper net comprises an elastic attached along the upper edge of the upper net adapted to keep the upper edge of the upper net taut on the apparatus.

In the kit, the support pieces that support the foam are in one embodiment brackets having a surface for attachment to the firm backing layer and a horizontal support surface that is 2 or more inches wide for supporting the foam pieces. In one embodiment, the horizontal support surface of each bracket is 2-5 inches wide.

All patents, patent documents, and other references cited are hereby incorporated by reference.

What is claimed is:

1. A tennis training apparatus comprising:

(a) a backboard comprising (i) a firm backing layer underneath (ii) a soft deadening layer comprising a resilient polymer foam layer that is at least 2 inches thick; mounted on (b) a stand;

wherein rebound of a tennis ball from the backboard is reduced as compared to rebound from a rigid hard-surface backboard, and wherein the apparatus is portable;

wherein the apparatus, excluding any detachable weights added to provide stability, weighs less than 100 pounds and can be moved by being carried by one adult of average strength without tools;

wherein the firm backing layer is composed primarily of plastic, has a back surface and a front surface, and has protruding ribs formed on its back surface that enhance rigidity of the plastic firm backing layer;

wherein the stand comprises a plurality of legs, the backboard has a top and a bottom edge and a right and a left edge, and the backboard is mounted on the stand such that the bottom edge of the backboard is 2.5-4.0 feet above the ground;

further comprising a lower net adapted to be attached directly or indirectly to the legs or firm backing layer and extend below the backboard to the ground to catch missed tennis balls below the backboard.

2. The tennis training apparatus of claim 1 wherein the lower net has an upper edge and includes a solid fabric band along the upper edge and the solid fabric band includes an elastic band to hold the upper edge of the net taut.

3. The tennis training apparatus of claim 1 further comprising a second net that is an upper net that is attached directly or indirectly to the firm backing layer and extends above the backboard to catch tennis balls that miss above the backboard.

4. The tennis training apparatus of claim 3 wherein the apparatus further comprises two upper net poles, and two or more net pole holders, wherein the net pole holders are attached directly or indirectly to the firm backing layer and hold the upper net poles, wherein the upper net has a left and right lateral edge and an upper edge and a lower edge, the upper net comprises fabric pockets on the left and right lateral edges adapted to fit over the upper net poles, and the upper net comprises an elastic attached along the upper edge of the upper net adapted to keep the upper edge of the upper net taut on the apparatus.

* * * * *